US009051803B2

(12) United States Patent
Leuchtenberg

(10) Patent No.: US 9,051,803 B2
(45) Date of Patent: Jun. 9, 2015

(54) APPARATUS FOR AND METHOD OF DRILLING A SUBTERRANEAN BOREHOLE

(75) Inventor: Christian Leuchtenberg, Belgium (DE)

(73) Assignee: Managed Pressure Operations PTE LTD, Singapore (SG)

( * ) Notice: Subject to any disclaimer, the term of this patent is extended or adjusted under 35 U.S.C. 154(b) by 779 days.

(21) Appl. No.: 13/262,595

(22) PCT Filed: Mar. 31, 2010

(86) PCT No.: PCT/EP2010/054387

§ 371 (c)(1),
(2), (4) Date: Dec. 20, 2011

(87) PCT Pub. No.: WO2010/115834

PCT Pub. Date: Oct. 14, 2010

(65) Prior Publication Data

US 2012/0090893 A1 Apr. 19, 2012

(30) Foreign Application Priority Data

Apr. 1, 2009 (GB) ..... 0905633.4

(51) Int. Cl.
*E21B 21/08* (2006.01)

(52) U.S. Cl.
CPC ..... *E21B 21/08* (2013.01)

(58) Field of Classification Search
CPC ..... E21B 21/08
USPC ..... 175/25, 38, 48, 207, 217
See application file for complete search history.

(56) References Cited

U.S. PATENT DOCUMENTS

| | | | |
|---|---|---|---|
| 704,423 | A | 7/1902 | Allen |
| 1,491,986 | A | 4/1924 | Greene |
| 2,102,555 | A | 12/1937 | Dyer |
| 2,158,356 | A | 5/1939 | Dyer |
| 3,298,385 | A | 1/1967 | Jackson, at al. |

(Continued)

FOREIGN PATENT DOCUMENTS

| | | | |
|---|---|---|---|
| CN | 1664302 | A | 9/2005 |
| CN | 2890321 | Y | 4/2007 |

(Continued)

OTHER PUBLICATIONS

GB International Search Report for GB0905633.4, Aug. 10, 2009, 1 page.

(Continued)

*Primary Examiner* — Brad Harcourt
*Assistant Examiner* — Steven MacDonald
(74) *Attorney, Agent, or Firm* — Bracewell & Giuliani LLP; Constance Gall Rhebergen; Linda L. Morgan

(57) ABSTRACT

A control apparatus for use in controlling the fluid pressure in a borehole during drilling of the borehole, the apparatus including an inlet suitable for connection to a pump, a main outlet suitable for connection to a drill pipe, and an overflow outlet suitable for connection to a fluid reservoir, the inlet being connected to the main outlet by a main flow conduit, and the overflow outlet being connected to the main flow conduit by means of an overflow conduit, wherein the overflow conduit is provided with a pressure regulator by means of which the pressure of fluid in the main flow conduit may be maintained at or around a predetermined pressure value.

26 Claims, 4 Drawing Sheets

(56) References Cited

U.S. PATENT DOCUMENTS

Figure 1:
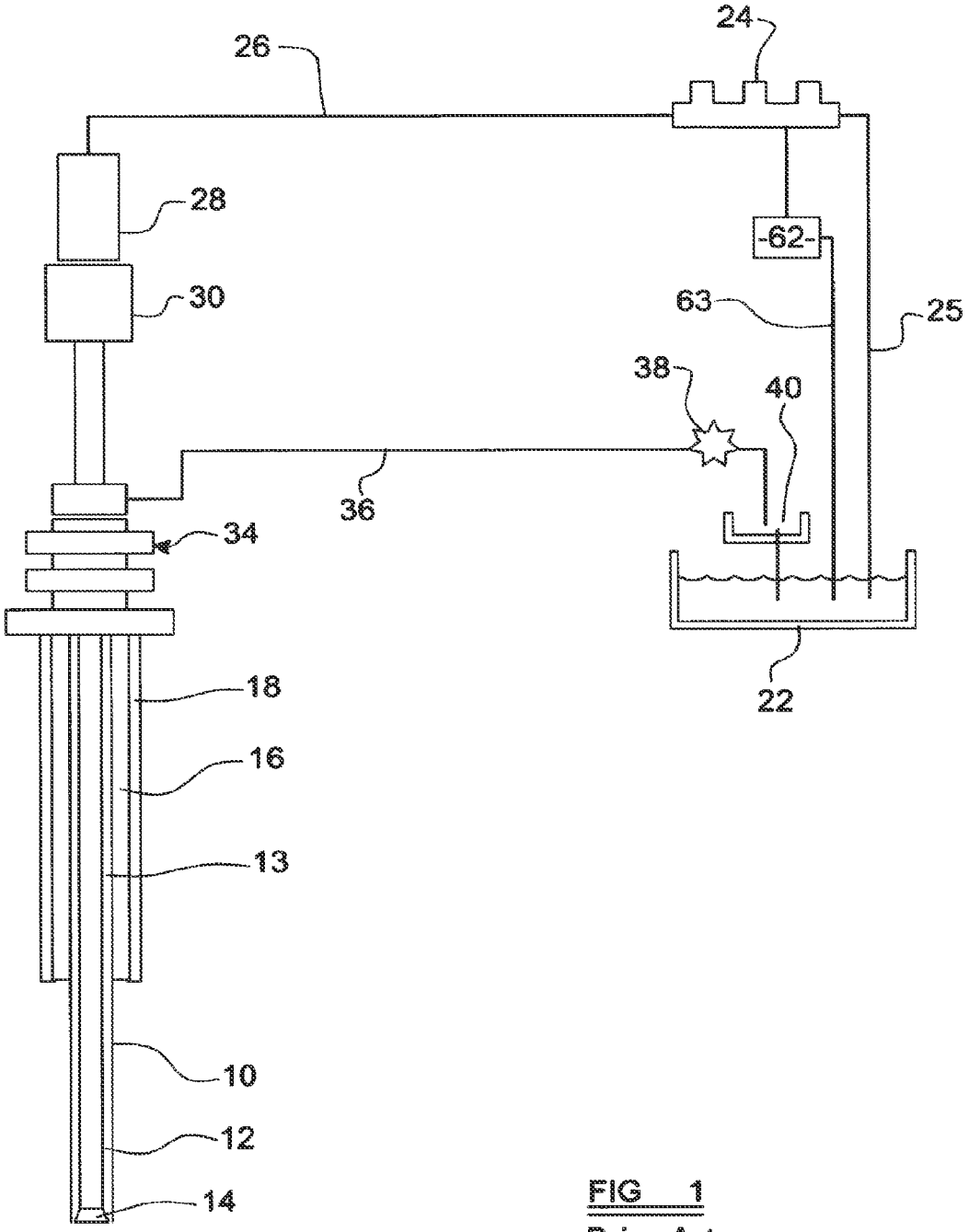
FIG 1 Prior Art

| | | | | |
|---|---|---|---|---|
| 3,338,319 | A * | 8/1967 | Griffin, III | 175/25 |
| 3,470,971 | A | 10/1969 | Dower | |
| 4,291,772 | A | 9/1981 | Beynet | |
| 4,448,267 | A | 5/1984 | Crawford, III et al. | |
| 4,630,675 | A | 12/1986 | Neipling et al. | |
| 4,685,520 | A | 8/1987 | McDaniel et al. | |
| 4,770,389 | A | 9/1988 | Bodine et al. | |
| 4,823,877 | A | 4/1989 | McDaniel et al. | |
| 4,867,254 | A | 9/1989 | Gavignet | |
| 5,070,949 | A | 12/1991 | Gavignet | |
| 5,080,182 | A | 1/1992 | Thompson | |
| 5,115,871 | A | 5/1992 | McCann et al. | |
| 5,431,188 | A | 7/1995 | Cove | |
| 5,628,493 | A | 5/1997 | McKnight et al. | |
| 5,975,219 | A | 11/1999 | Sprehe | |
| 6,176,323 | B1 | 1/2001 | Weirich et al. | |
| 6,244,631 | B1 | 6/2001 | Payne et al. | |
| 6,315,051 | B1 | 11/2001 | Ayling | |
| 6,374,925 | B1 | 4/2002 | Elkins et al. | |
| 6,527,062 | B2 | 3/2003 | Elkins et al. | |
| 6,814,142 | B2 | 11/2004 | Paulk et al. | |
| 6,904,981 | B2 | 6/2005 | van Riet | |
| 7,044,237 | B2 | 5/2006 | Leuchtenberg | |
| 7,107,875 | B2 | 9/2006 | Haugen et al. | |
| 7,185,719 | B2 * | 3/2007 | van Riet | 175/66 |
| 7,395,878 | B2 | 7/2008 | Reitsma et al. | |
| 2003/0079912 | A1 | 5/2003 | Leuchtenberg | |
| 2003/0139916 | A1 | 7/2003 | Choe et al. | |
| 2003/0168258 | A1 | 9/2003 | Koederitz | |
| 2005/0092523 | A1 | 5/2005 | McCaskill et al. | |
| 2006/0060360 | A1 | 3/2006 | Moncus et al. | |
| 2006/0124352 | A1 | 6/2006 | Krueger et al. | |
| 2006/0254822 | A1 | 11/2006 | Ayling | |
| 2006/0278434 | A1 | 12/2006 | Calderoni et al. | |
| 2007/0151762 | A1 | 7/2007 | Reitsma | |
| 2007/0231158 | A1 | 10/2007 | Butler et al. | |
| 2008/0060846 | A1 * | 3/2008 | Belcher et al. | 175/25 |
| 2008/0078586 | A1 | 4/2008 | Tettleton et al. | |
| 2008/0105434 | A1 | 5/2008 | Orbell et al. | |
| 2009/0025930 | A1 | 1/2009 | Iblings et al. | |
| 2009/0242817 | A1 | 10/2009 | Strazhgorodskiy | |
| 2009/0288821 | A1 * | 11/2009 | Eriksen et al. | 166/250.01 |

FOREIGN PATENT DOCUMENTS

| | | | |
|---|---|---|---|
| CN | 1688793 | A | 7/2009 |
| EP | 1227215 | B1 | 7/2002 |
| EP | 1248065 | A2 | 10/2002 |
| EP | 1048819 | B1 | 2/2004 |
| EP | 1754947 | A2 | 2/2007 |
| GB | 2119046 | A | 11/1983 |
| GB | 2290330 | A | 12/1995 |
| GB | 2314106 | A | 12/1997 |
| GB | 2427217 | B | 10/2008 |
| GB | 2451699 | A | 2/2009 |
| JP | 2007174548 | A | 7/2007 |
| WO | WO 0236928 | A1 | 5/2002 |
| WO | 0250398 | A1 | 6/2002 |
| WO | WO 2004074627 | A1 | 9/2004 |
| WO | WO 2005019596 | A1 | 3/2005 |
| WO | WO 2005080745 | A1 | 9/2005 |
| WO | WO 2007005822 | A2 | 1/2007 |
| WO | 2007081711 | A2 | 7/2007 |
| WO | WO 2007124330 | A2 | 11/2007 |
| WO | WO 2008051978 | A1 | 5/2008 |
| WO | WO 2008095650 | A1 | 8/2008 |
| WO | WO 2008156376 | A1 | 12/2008 |
| WO | WO 2009018173 | A2 | 2/2009 |
| WO | WO 2009022914 | A1 | 2/2009 |
| WO | WO 2010046653 | A2 | 4/2010 |

OTHER PUBLICATIONS

Adri Schouten, PCT International Search Report for PCT/EP2010/054387, Sep. 23, 2010, 2 pages.

Skalle, Pal, "Trends Extracted From 800 Gulf Coast Blowouts During 1960-1996" Society of Petroleum Engineers, IADC/SPE 39354, 1998 IADC/SPE Drilling Conference held in Dallas, Texas, Mar. 3-6, 1998, pp. 539-546.

Schubert, J.A. and Wright, J.C., "Early Kick Detection Through Liquid Level Monitoring in the Wellbore" Society of Petroleum Engineers, IADC/SPE 39400, 1998 IADC/SPE Drilling Conference held in Dallas, TX, Mar. 3-6, 1998, pp. 889-895, Copyright 1998, IADC/SPE Drilling Conference.

Hutchinson, M., Rezmer-Cooper, A and L. and Schlumberger, "Using Downhole Annular Pressure Measurements to Anticipate Drilling Problems" Society of Petroleum Engineers, SPE 49114, 1998 SPE Annual Technical Conference and Exhibition held in New Orleans, LA, Sep. 27-30, 1998, pp. 535-549, Copyright 1998, Society of IADC/SPE Drilling Conference.

PCT International Search Report, dated Nov. 3, 2010, International Application No. PCT/EP2010/063579, filed Sep. 15, 2010.

GB International Search Report for GB0905802.5, Jul. 31, 2009, 2 pages.

Stephane Ott, PCT International Search Report for PCT/GB2010/050571, Dec. 17, 2010, 2 pages.

AU Patent Examination Report No. 1 for 2010233847, Jan. 30, 2014, 4 pages.

CN Search Report for 201080014561.7, 1 page.

EP Examination Report for 10712082.6, Apr. 22, 2013, 2 pages.

Tian et al., "Parametric Analysis of MPD Hydrolics". IADC/SPE Intl. 108354-PP (Mar. 28, 2007).

Co-pending U.S. Appl. No. 12/882,344, filed Sep. 15, 2010.

Co-pending U.S. Appl. No. 13/223,676, filed Sep. 1, 2011.

* cited by examiner

APPARATUS FOR AND METHOD OF DRILLING A SUBTERRANEAN BOREHOLE

RELATED APPLICATION

This application claims priority to PCT application PCT/EP2010/054387 filed Mar. 31, 2010, which claims priority to British patent application GB 0905633A filed Apr. 1, 2009.

DESCRIPTION OF INVENTION

The present invention relates to an apparatus for and a method of drilling a subterranean borehole, particularly, but not exclusively for the purpose of extracting hydrocarbons from a subterranean oil reservoir.

The drilling of a borehole or well is typically carried out using a steel pipe known as a drill pipe with a drill bit on the lowermost end. The entire drill pipe may be rotated using an over-ground drilling motor, or the drill bit may be rotated independently of the drill pipe using a fluid powered motor or motors mounted in the drill pipe just above the drill bit. As drilling progresses, a flow of mud is used to carry the debris created by the drilling process out of the borehole. Mud is pumped through an inlet line down the drill pipe to pass through the drill bit, and returns to the surface via the annular space between the outer diameter of the drill pipe and the borehole (generally referred to as the annulus). The mud flow also serves to cool the drill bit, and to pressurise the borehole, thus substantially preventing inflow of fluids from formations penetrated by the borehole from entering into the borehole. Mud is a very broad drilling term, and in this context it is used to describe any fluid or fluid mixture used during drilling and covers a broad spectrum from air, nitrogen, misted fluids in air or nitrogen, foamed fluids with air or nitrogen, aerated or nitrified fluids to heavily weighted mixtures of oil or water with solid particles.

Significant pressure is required to drive the mud along this flow path, and to achieve this, the mud is typically pumped into the drill pipe using one or more positive displacement pumps which are connected to the drill pipe via a pipe and manifold known as the standpipe manifold. When operating at a constant speed, the pump displaces a constant volume of mud per unit time. As a result, if something happens to alter the rate of flow of the mud along the drill pipe, if the pump is operating at a constant speed, the pressure of the mud in the drill pipe will change.

For example, if a blockage occurs in the drill pipe, the pressure in the drill pipe will rapidly increase. Alternatively, if the driller drives the bit into the formation being drilled with too much weight then this in itself can cause an increase in the mud pressure in the drill pipe as the flow out of the drill bit into the annulus is restricted. Another common cause of increasing pressure in the drill pipe is when using a downhole drilling motor. If the torque at the bit exceeds the power of the motor, the motor stalls, which results in the standpipe pressure increasing as fluid flow is reduced through the motor in the stalled condition. At this stage, the driller has to take care not to just pick up the drill bit, to reduce the torque allowing the motor to restart, but he also has to reduce the pressure in the drill pipe so that the motor does not over speed on restarting.

If the mud pressure in the drill pipe becomes too high, the drilling motor may fail and/or the drill pipe walls may be damaged. In order to prevent this, the or each pump is provided with a safety valve known as a pop-off valve. If the pressure in the drill-pipe exceeds a predetermined level, the pop-off valve or at least one of the pop-off valves will be actuated. This stops the drilling process, and relieves the excess pressure in the drill pipe. Each actuated valve must be reset manually before drilling can be restarted. It will be appreciated that this is highly disruptive to the drilling process, and therefore it is desirable to avoid fluctuations in drill pipe pressure which are likely to result in actuation of one or more pop-off valves.

To avoid this, it is known for a drill operator to monitor the mud pressure in the drill pipe, typically by means of a pressure gauge provided in the standpipe manifold, and to vary the speed of operation of the pump in order to maintain the mud pressure in the drill pipe at an acceptable level. A disadvantage of operating the drill system in this way is that it is subject to human error and relies on the operator reacting promptly to a sudden rise in pressure, and, even if the operator reacts quickly, because of the inherent inertia of the pump, there is an inevitable time delay before the pump slows to the desired speed and before the change in pump speed takes effect downhole.

It will also be appreciated that the bottom hole mud pressure in the borehole is dependant on the flow of mud through the drill pipe. If this decreases, because of a plugging of the drill pipe, the application of excessive weight to the bit or stalling of the motor, the bottom hole mud pressure will decrease. If the mud pressure in the borehole becomes too low, this may cause the unintended release of hydrocarbon products from the formation.

In an attempt to avoid this, it is also known to control the mud pressure in the borehole by applying a back-pressure to mud exiting from the annulus of the borehole. Such a system is, for example, disclosed in US 2007/0151762. Conventionally, mud from the annulus flows along a return line through a filter (screens) or series of filters and into a mud reservoir. In a first proposal set out in US2007/0151762, a second pump is provided in a line extending between the return line and the mud reservoir, and the pump controlled to apply the degree of back-pressure to mud in the return line required to maintain the bottom hole pressure at the desired value. If no back-pressure is required, a valve between the return line and the back-pressure pump is closed. This proposal, of course, has a disadvantage that a second pump is required, which adds to the cost and complexity of the system.

This problem is overcome in the second proposal disclosed in US2007/0151762 in which the back-pressure is applied using the existing main rig pump. In this case, a line is provided from the inlet line to the return line, and a back pressure control valve is provided to control flow of fluid through this additional line. Opening of the back pressure control valve causes a proportion of the mud being pumped by the main rig pump to be prevented from flowing into the drill pipe and diverted instead to the return line, where it increases the back pressure in the return line. It is therefore suggested that the bottom hole pressure can be controlled using this valve. Controlling the bottom hole pressure in this way, whilst theoretically possible, would be very difficult to achieve in practice, at least to any degree of accuracy and within a reasonable timescale. Opening the back pressure control valve not only has the effect of increasing the back-pressure in the return line, but also decreasing the pressure of mud entering the drill pipe, and this combined effect means that the effect of opening the valve is not straightforward to predict and, it is likely that numerous iterations and adjustments of the back pressure control valve would be required to achieve the desired bottom hole pressure.

According to a first aspect of the invention we provide a control system for use in controlling the fluid pressure in a borehole during drilling of the borehole, the system including an inlet suitable for connection to a pump, a main outlet suitable for connection to a drill pipe, and an overflow outlet suitable for connection to a fluid reservoir, the inlet being connected to the main outlet by a main flow conduit, and the overflow outlet being connected to the main flow conduit by means of an overflow conduit, wherein the overflow conduit is provided with a pressure regulator by means of which the pressure of fluid in the main conduit may be maintained at or around a predetermined pressure value.

By virtue of the provision of such an overflow conduit, when the control system is fitted to drilling system with the inlet connected to the main rig mud pump, the main outlet connected to the drill pipe, and the overflow outlet connected to the mud reservoir, the mud pressure in the drill pipe can be maintained at a generally constant pressure without any intervention by the driller. Any of the events described above—plugging of the drill pipe, application of excessive weight to the bit or stalling of the motor, the driller does not have to adjust the pump speed to avoid actuation of one or more pop-off valves.

Preferably the pressure regulator comprises a choke which is adjustable to restrict flow of fluid along the overflow conduit to a greater or lesser extent.

Preferably the pressure regulator includes a pressure sensor which provides an input signal indicative of the fluid pressure in either the main flow conduit or in the overflow conduit between the choke and the main conduit. Whilst the choke may be manually adjustable, preferably the pressure regulator also includes an electronic control unit which is connected to the pressure sensor to receive the input signal from the pressure sensor, the electronic control unit being further connected to the choke and programmed to generate and transmit to the choke a control signal, receipt of which causes the choke to adjust the extent to which fluid flow along the overflow conduit is restricted. Preferably the electronic control unit is programmed to monitor the input signal from the pressure sensor and if the pressure differs to a specified extent from a predetermined value, to calculate and transmit to the choke one or more appropriate control signals to return the pressure to the predetermined value. By virtue of the provision of such an electronic control unit, the bottom hole mud pressure may automatically be controlled and maintained at a desired level.

Further preferably, the electronic control unit is provided with an input adapted to receive a signal indicating the desired pressure of fluid in either the main flow conduit or the overflow conduit between the choke and the main conduit, and is programmed to calculate and transmit to the choke an appropriate control signal to achieve the desired pressure. This enables a user to alter the pressure at which the system is automatically maintained.

The apparatus may also include a further choke which is located in the main conduit between the overflow conduit and the main outlet and which is adjustable to vary the degree of restriction of flow of fluid along the main conduit.

A valve may be provided in the overflow conduit, the valve being movable from an open position in which flow of fluid along the overflow conduit is permitted and a closed position in which the valve acts to substantially prevent flow of fluid along the overflow conduit.

The apparatus may include an annulus outlet which is connected to the main conduit between the overflow conduit and the main outlet by an annulus conduit. In this case, preferably yet another adjustable choke is provided in the annulus conduit. Where a choke is provided in the main conduit, preferably the annulus conduit is connected to the main conduit between the overflow conduit and the choke in the main conduit.

According to a second aspect of the invention we provide a drilling system including drill pipe, a pump, a fluid reservoir and a control apparatus according to the first aspect of the invention, the inlet of the control apparatus being connected to the pump, the main outlet of the control apparatus being connected to the drill pipe, and the overflow outlet of the control apparatus being connected to the fluid reservoir.

Preferably a pressure containment device is provided around the drill pipe, the pressure containment device being capable of containing fluid pressure in the annular region around the drill pipe. In this case, the pressure containment device may be a rotating control device, the rotating control device being capable of containing fluid pressure in the annular region around the drill pipe whilst allowing for rotation of the drill pipe about its longitudinal axis.

An annulus return conduit is preferably provided between the annular region around the drill pipe and the fluid reservoir. In this case, where a pressure containment device is provided, the annulus return conduit may be provided with a pressure regulator by means of which the pressure in the annular region around the drill pipe may be adjusted. The pressure regulator preferably comprises a choke which is adjustable to restrict flow of fluid along the annulus return conduit to a greater or lesser extent, and may include a pressure sensor which provides a signal indicative of the fluid pressure in the annular region around the drill pipe. The pressure regulator may also include an electronic control unit which is connected to the pressure sensor to receive an input signal from the pressure sensor indicative of the fluid pressure in the annular region around the drill pipe, the electronic control unit being further connected to the choke and programmed to generate and transmit to the choke a control signal, receipt of which causes the choke to adjust the extent to which fluid flow along the annulus return conduit is restricted. In this case, the electronic control unit is preferably programmed to monitor the input signal from the pressure sensor and if the pressure in the annular region around the drill pipe differs to a specified extent from a predetermined value, to calculate and transmit to the choke one or more appropriate control signals to return the pressure to the predetermined value. Moreover, the electronic control unit may be provided with an input adapted to receive a signal indicating the desired pressure of fluid in the annular region around the drill pipe, and is programmed to calculate and transmit to the choke an appropriate control signal to achieve the desired pressure.

Advantageously, the drilling system further includes an annulus conduit which extends from the main conduit to the annular region around the drill pipe. The annulus conduit is preferably provided with a choke which is adjustable to restrict flow of fluid along the annulus conduit to a greater or lesser extent. Further preferably the annulus conduit is provided with a valve which is operable to substantially prevent flow of fluid along the annulus conduit.

According to a third aspect of the invention we provide a method of operating a drilling system including a control apparatus, the control apparatus having an inlet, a main outlet and an overflow outlet, the inlet being connected to the main outlet by a main flow conduit and the overflow outlet being connected to the main conduit by an overflow conduit, the overflow conduit being provided with a pressure regulator, the drilling system further including a drill pipe connected to the main outlet of the control apparatus, a pump connected the inlet of the control apparatus, and a fluid reservoir connected to the overflow outlet, wherein the method includes the steps of operating the pump to pump fluid into the drill pipe via the main flow conduit of the control apparatus, and operating the pressure regulator to maintain the pressure of fluid in the overflow conduit at or around a predetermined level.

Preferably the pressure regulator comprises an adjustable choke, and the method includes the steps of adjusting the choke to increase restriction of fluid flow along the overflow conduit if the pressure of fluid in the overflow conduit is below the predetermined level or adjusting the choke to decrease restriction of fluid flow along the overflow conduit if the pressure of fluid in the overflow conduit is above the predetermined level.

The control apparatus may also include a further choke which is located in the main conduit between the overflow conduit and the main outlet, in which case the method may also include the step of operating the main choke to alter the extent to which flow of fluid along the main conduit is restricted. The provision of such a choke is advantageous as it means that one control needs to be manipulated in order to alter the flow of mud along the drill pipe, even if two mud pumps are being used.

Preferably the pump is connected to the mud reservoir such that operation of the pump causes fluid in the reservoir to be pumped into the control apparatus.

The drilling system may include an annulus return conduit which extends between the annular region around the drill pipe and the fluid reservoir, the annulus return conduit being provided with a choke which is adjustable to restrict flow of fluid along the annulus return conduit to a greater or lesser extent, in which case the method may further include the steps of operating the choke to bring the pressure in the annular region around the drill pipe to or maintain the pressure at a desired level.

The drilling system may further include a main choke which is located in the main flow conduit between the overflow conduit and the main outlet and which is adjustable to vary the degree of restriction of flow of fluid along the main conduit, and an annulus conduit which extends from the main conduit to the annular region around the drill pipe, the annulus conduit being provided with an annulus choke which is adjustable to restrict flow of fluid along the annulus conduit to a greater or lesser extent, in which case, the method may further include the steps of, during operation of the pump to pump fluid into the main flow conduit, adjusting the annulus choke to decrease the restriction on flow of fluid along the annulus conduit until the rate of flow of fluid along the annulus conduit reaches a predetermined amount, then adjusting the main choke to increase the restriction of flow of fluid along the main conduit, whilst at the same time adjusting the annulus return choke to increase the restriction of flow of fluid along the annulus return conduit. Furthermore, the method may include the step of adjusting the main choke until flow of fluid through the main choke is substantially prevented, and then disconnecting the drill pipe from the main outlet.

Alternatively or additionally the method may further include the steps of, during operation of the pump to pump fluid into the main flow conduit, adjusting the main choke to decrease the restriction of flow of fluid along the main conduit, whilst at the same time adjusting the annulus return choke to decrease the restriction of flow of fluid along the annulus return conduit, and then. adjusting the annulus choke to increase the restriction on flow of fluid along the annulus conduit until the rate of flow of fluid along the annulus conduit is substantially prevented.

Figure 2:
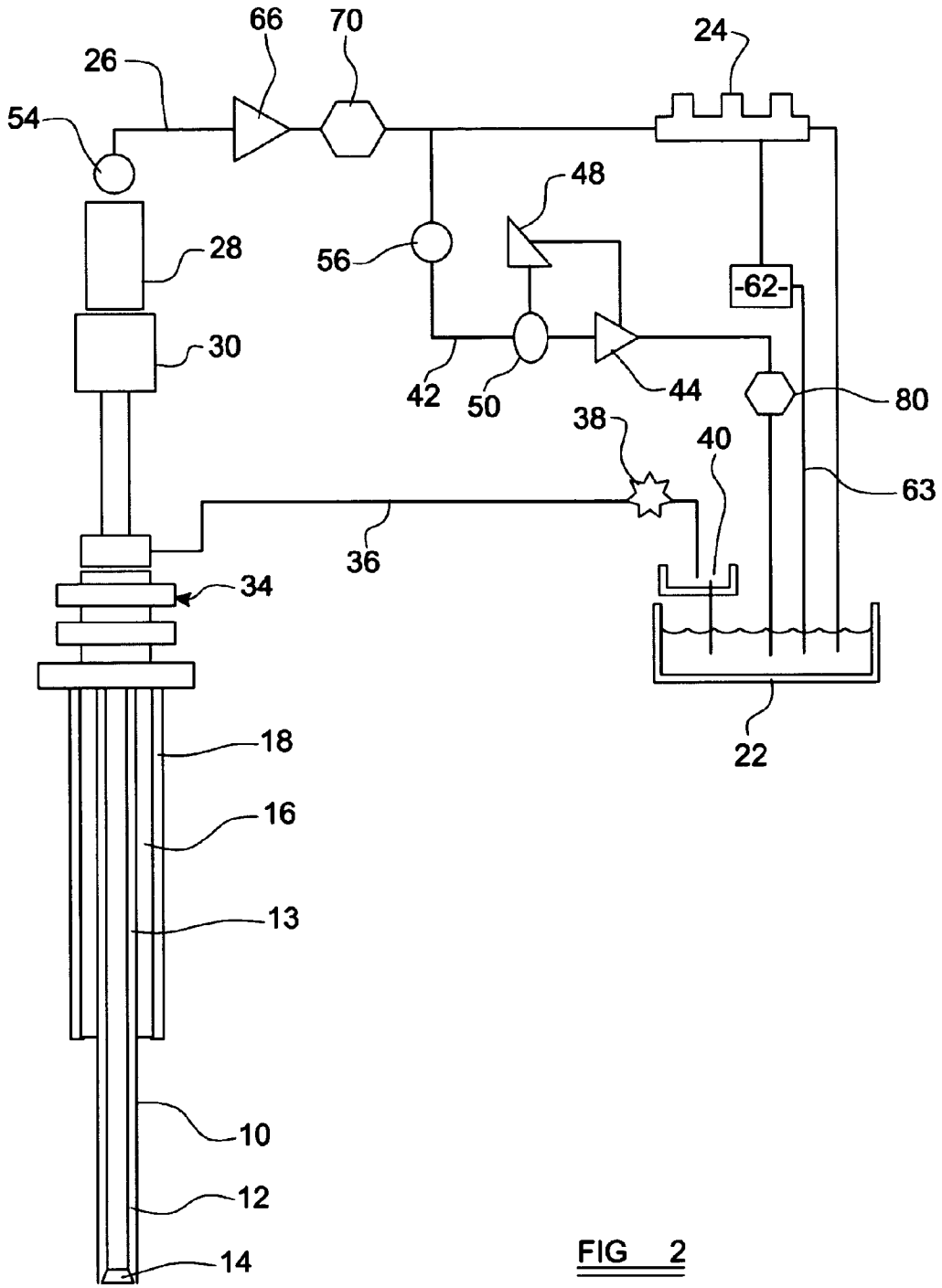
Figure 3:
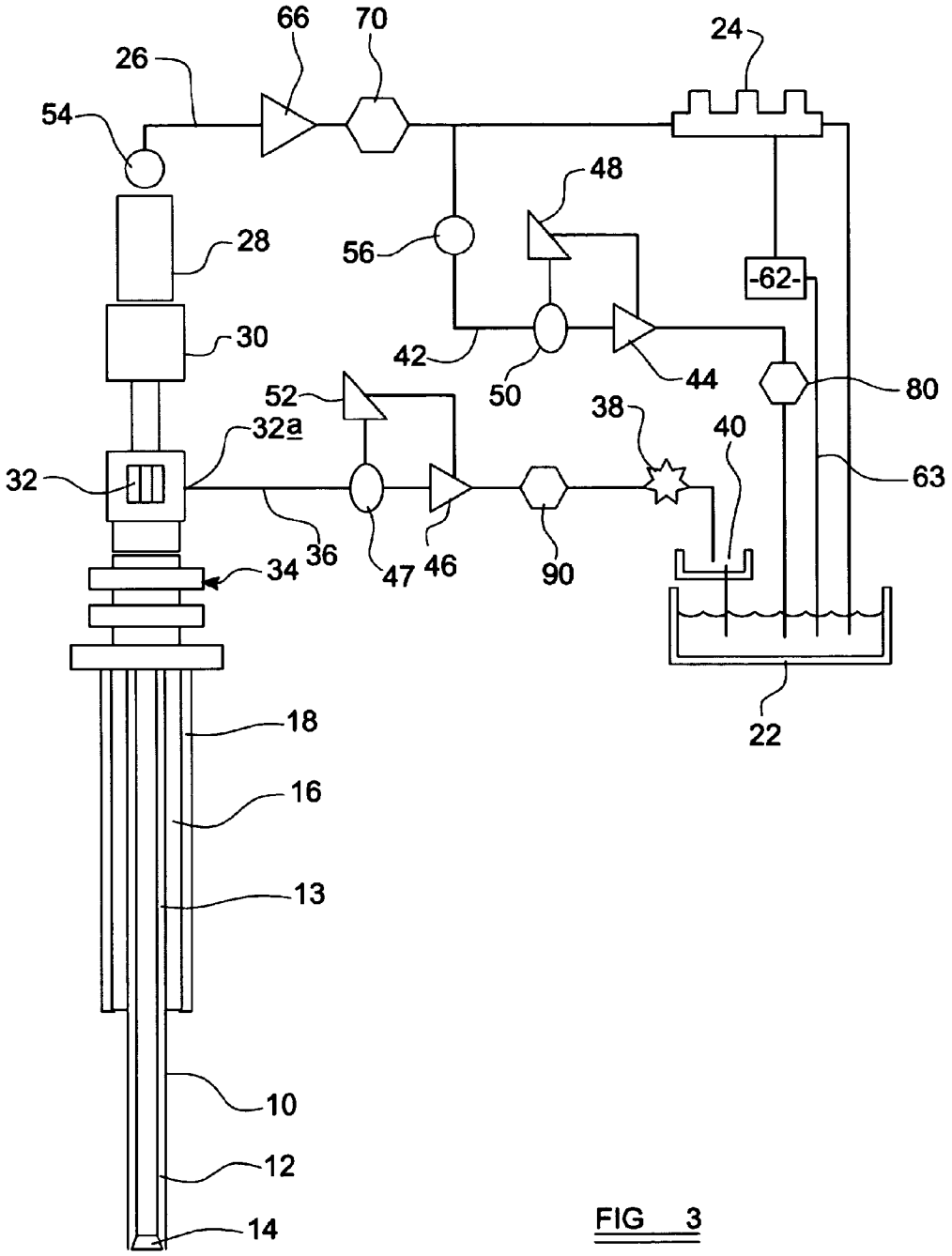
Figure 4:
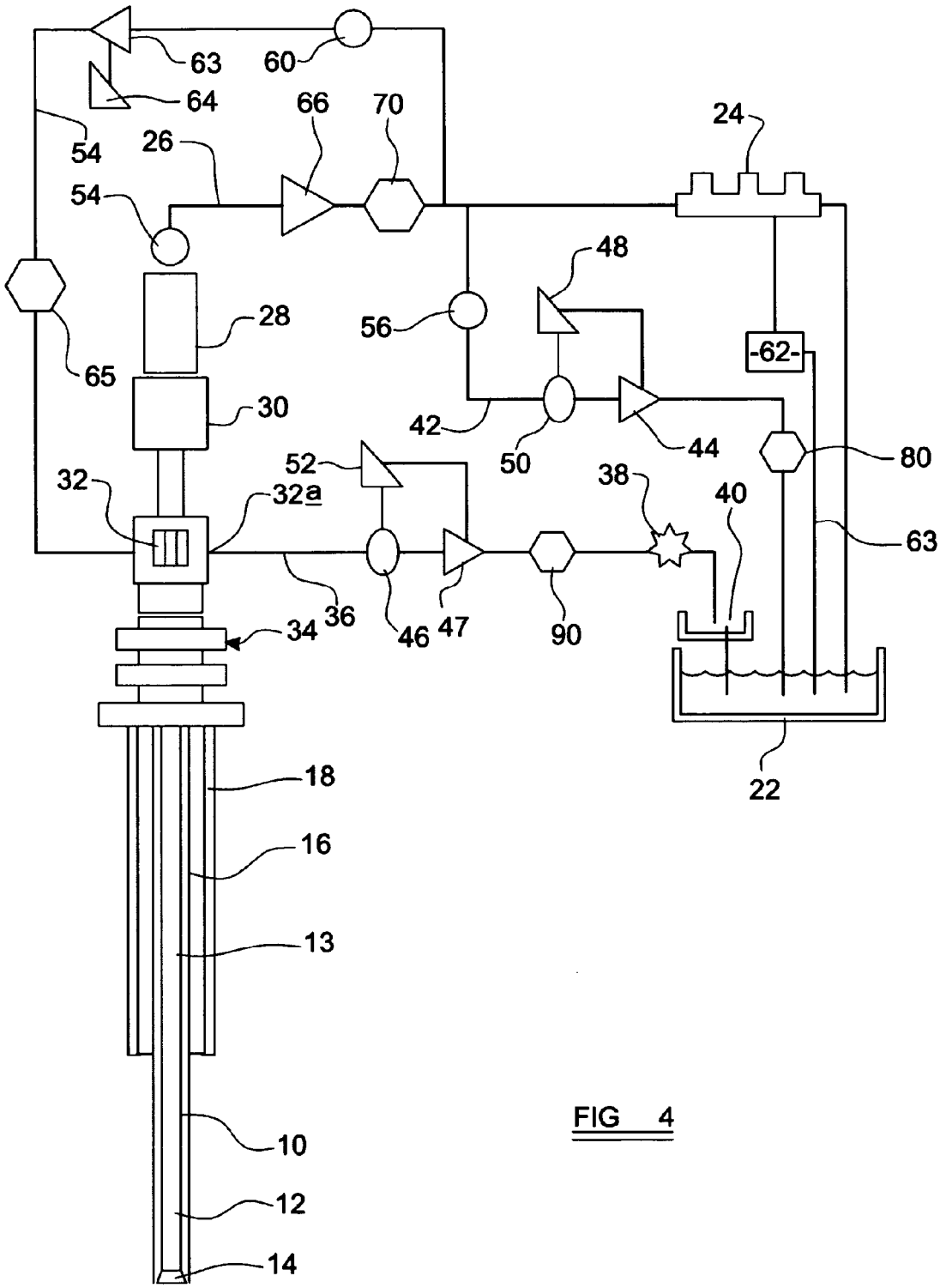

Embodiments of the invention will now be described with reference to the following figures of which, FIG. 1 shows a schematic illustration of a prior art drilling system, FIG. 2 shows a schematic illustration of a drilling system including a control system according to the first aspect of the invention, FIG. 3 shows a schematic illustration of a drilling system including a second embodiment of control system according to the first aspect of the invention, FIG. 4 shows a schematic illustration of a drilling system including a third embodiment of control system according to the first aspect of the invention, Referring now to FIG. 1, there is shown a schematic illustration of a prior art land-based drilling system including a partially drilled borehole 10 which extends generally vertically into a subterranean formation, and a drill pipe 12 extending into the borehole 10, leaving an annular space, hereinafter referred to as the annulus 13, between the outer diameter of the drill pipe 12 and the walls of the bore hole 10. The lowermost end of the drill pipe 12 is provided with a bottom hole assembly (BHA) 14 comprising a drill bit and a plurality of sensors preferably including a pressure transducer which is configured to generate a pressure signal indicative of the bottom hole fluid pressure. The uppermost section of the borehole is lined with a casing 16, a layer of cement 18 extending between the casing 16 and the sides of the bore hole 10.

Whilst the BHA 14 could be provided with a mud motor which is operable to rotate the drill bit, in this example, drilling is achieved by rotating the entire drill pipe 12, using an over-ground drilling motor, or top-drive 30 which is mounted on top of the drill pipe 12. The drill pipe 12 extends out of the bore hole 10 through a blow out preventer (BOP) 34 to the top drive 30.

The system is further provided with a mud reservoir 22, and a mud pump 24 which is precharged with mud drawn by a precharge pump from the mud reservoir 22 via a first conduit 25. The mud pump 24 pumps the mud into a standpipe manifold 28 via a second conduit 26, hereinafter referred to as the main conduit 26. The standpipe manifold 28 is connected to the top drive 30, and mud pumped into the standpipe manifold 28 passes through the top drive 30 and into the drill pipe 12. The standpipe manifold 28 is provided with a pressure sensor, the output of which constitutes an indication of the pressure in the drill pipe 12 and is displayed at a drillers station.

The mud pump 24 has a safety device called a pop-off valve 62 which releases pressure from the main conduit 26 if this is completely plugged or unintentionally shut in at the standpipe manifold 28. The pop-off valve 62 is located in a pressure relief conduit 63 which extends from the mud pump 24 to the mud reservoir 22. The pop-off valve 62 has to be set manually at the required maximum pressure, which is usually dependant on the pump specification. If the pop-off valve 62 is actuated, it must be reset manually.

The pump 24 is operated using a variable speed driver which may be mechanical (a diesel engine) or electrical (an electric motor). The variable speed driver is controlled by a remote device on the rig floor, with the pump normally being situated elsewhere, typically on the ground. During a drilling operation, the driller continuously adjust the driver, based on the output from the standpipe manifold pressure gauge, in order to maintain the pressure in the drill pipe 12 at the desired level.

Although in this example, the system is described as having a single mud pump 24, it should be appreciated that more than one pump could be provided. In this case, each pump is provided with a variable speed driver, and the driller must adjust both drivers in order to maintain the pressure in the drill pipe 12 at the desired level.

Once pumped down the drill pipe 12, the mud pass through the drill bit 14 and into the annulus 13. Having moved up the annulus 13, the mud then flows into a third conduit 36, hereinafter referred to as the annulus return conduit 36, which extends from an uppermost portion of the BOP 34. The annulus return conduit 36 extends from the annulus 13 to return mud back to the mud reservoir 22 via at least one filter 38 and shaker 40, by means of which particulate matter such as drill cuttings can be removed from the returning mud.

The drilling system shown in FIG. 2 is distinguished from such prior art systems by virtue of the provision of a fourth conduit 42, hereinafter referred to as the overflow conduit 42, which extends from the main conduit 26, i.e. from the line between the main mud pump 24 and the standpipe manifold 28, to the mud reservoir 22. Thus, during operation of the mud pump 24, some of the pumped mud flows into the standpipe manifold 28, and hence the drill pipe 12, whilst some of the pumped mud is returned directly to the mud reservoir 22 via the overflow conduit 42.

In the overflow conduit 42 is provided a variable aperture orifice, which is, in this example, a controllable overflow choke 44 which may be operated to vary the extent to which fluid flow along the overflow conduit 42 is restricted. It will be appreciated that, if the pump 24 is pumping mud at a constant flow rate, closing the overflow choke 44 will decrease the rate of mud flow along the overflow conduit 42, and hence lead to an increase in the pressure of mud in the overflow conduit 42 between the main conduit 26 and the overflow choke 44. As flow of mud between the main conduit 26 and the overflow conduit 42, and between the main conduit 26 and the BHA 14 of the drill pipe 12 is, under normal circumstances, substantially unrestricted, an increase in mud pressure in the overflow conduit 42 results in a corresponding increase in mud pressure in the main conduit 26 and drill pipe 12, and a greater proportion of the pumped mud will flow into the drill pipe 12. Conversely, it will be appreciated that opening the overflow choke 44 will increase the rate of mud flow along the overflow conduit 42, and hence lead to a decrease in the pressure of mud in the overflow conduit 42, second conduit 26 and drill pipe 12.

Whilst it would be possible to operate the controllable overflow choke 44 manually to bring the mud pressure in the drill pipe 12 to or maintain it at a desired value, in this example, this is achieved automatically by means of an electronic control unit (ECU) 48 which is connected to the overflow choke 44 and which is operable to transmit a control signal, which may be pneumatic, hydraulic or electrical, to the overflow choke 44, receipt of which causes the overflow choke 46 to open or close by a specified amount. Such signal controllable chokes are well known in the art.

In this example, a pressure transducer 50 is mounted in the conduit 42 between the overflow choke 44 and the main conduit 26, and provides an electrical output signal which is indicative of the pressure of fluid at that point in the overflow conduit 42. The pressure transducer 50 is connected to an input of the ECU 48, and by means of this connection, the output signal from the pressure transducer 50 is transmitted to the ECU 48. The ECU 48 is programmed such that if the output signal from the pressure transducer 50 indicates that the mud pressure in the overflow conduit 42 has deviated by more than a predetermined amount from a pre-selected value (hereinafter referred to as the set pressure), the ECU 48 generates and transmits to the overflow choke 44 an appropriate control signal so that, if the pressure is too high, the overflow choke 44 opens so that fluid flow along the overflow conduit 42 is less restricted, and if the pressure is too low, the overflow choke 44 closes (partially—not completely) so that fluid flow along the overflow conduit 44 is more restricted.

It should be appreciated, however, that the pressure transducer could be located in the main conduit 26, and therefore provide the ECU 48 with an electrical output signal which is indicative of the pressure of fluid in the main conduit 26.

The ECU 48 may be programmed such that the control signal may simply include an instruction to the overflow choke 44 to open or close by a pre-determined relatively small degree, and send repeated control signals to the overflow choke 44 until the output signal from the pressure transducer 50 indicates that the mud pressure in the overflow conduit 42 is at the desired valve. Alternatively, the ECU 48 may be programmed such that the control signal includes not only an indication as to whether the overflow choke 44 is to open or close, but also by how much. In this case, the ECU 48 is programmed to calculate the degree of opening or closing of the overflow choke 44 required to bring the mud pressure in the overflow conduit 42 to the desired value, and to achieve this by sending an appropriate control signal to the overflow choke 44.

In this example the ECU 48 is programmed to maintain the mud pressure in the overflow conduit 42 between second conduit 26 and the overflow choke 44 around a set pressure of 2000 psi.

By virtue of this arrangement, accurate and reliable control over the mud pressure in the drill pipe 12 may be achieved without the need for manual control of the pump speed.

As a proportion of the pumped mud is returned directly to the mud reservoir without passing along the drill pipe 12, it is necessary to run the mud pump 24 at a slightly higher rate (around 10-15% higher) than would be required in prior art systems in which all of the pumped mud enters the drill pipe 12. If, during drilling, the annulus 13 becomes blocked or there is plugging of the drill bit, or if the drilling motor stalls, there will be a sudden and sharp increase in mud pressure in the drill pipe 12, which will be followed almost immediately by a similar increase in mud pressure in the second 26 and fourth conduits 42. This will be detected by the pressure transducer 50, and the ECU 48 will operate to cause the overflow choke 44 to open and thus relieve the excess pressure by allowing increased mud flow along the overflow conduit 42 to the mud reservoir 22. This adjustment can be achieved automatically and very rapidly, and will take effect without significant delay, in contrast to the prior art method of manual adjustment of the pump speed. As the mud pressure in the drill pipe 12 is maintained automatically at a preselected level, actuation of the pop-off valve can therefore be avoided under normal circumstances without the need for the intervention of the driller. The pop-off valves are therefore provided as pure safety valves for actuation only in the unlikely event of a failure of this pressure control system.

In a preferred embodiment of the invention, the ECU 48 includes a further input by means of which an operator may alter the set pressure if drilling conditions dictate that a higher or lower pressure of mud in the drill pipe 12 is required. Preferably this is achieved remotely, for example from a rig control centre. This input may also be used manually to alter the mud pressure in the drill pipe 12, for example, in case of failure of the automatic control system.

In this embodiment of the invention, valves 54, 56 are provided in the main conduit 26 and the overflow conduit 42 respectively. These valves 54, 56 are movable between an open position in which flow of fluid along the respective conduit is substantially unrestricted, and a closed position in which flow of fluid along the respective conduit is substantially prevented. It will be appreciated that by closing the valve 56 in the overflow conduit 42, the drilling system can be operated like a conventional drilling system, with control of the pressure of mud being pumped into the drill pipe 12 being achieved by altering the speed of operation of the main mud pump 24.

The provision of the valve 54 in the second conduit 26 means that it is not necessary to shut down the or each pump 24 during connection of a new length of tubular to the drill pipe 12. The valve 54 can be closed whilst the new tubular is connected to the drill pipe 12, the mud pumped by the pump 24 being returned directly to the mud reservoir via the overflow conduit 42.

Although not essential, this embodiment of drilling system may also include an electronically controllable main choke 66 in the main conduit 26 between the standpipe manifold 28 and the overflow conduit 42. An electronic control unit is provided which can be operated from the rig floor to control operation of the main choke 66, so that the main choke 66 can be closed to restrict mud flow into the standpipe manifold 28 or opened to increase mud flow into the standpipe manifold 28. As described above, the adjustable overflow choke 44 in the overflow conduit 42 is used to maintain the pressure in the main conduit 26 at a generally constant level, and it will be appreciated that the main choke 66 therefore provides means for varying the rate of mud flow into the drill pipe 12 without altering the speed of operation of the pump 24. The main choke 66 may be operable to close the main conduit 26 completely, i.e. to substantially prevent, rather than simply restrict or impede, flow of mud along the main conduit 26 or a separate valve may be provided for this purpose.

One or more flow meters (for example Coriolis flow meters) may be provided in the drilling system. For example, a flow meter 70 may be provided in the main conduit 26 between the junction with the overflow conduit 44 and the standpipe manifold 28, or, where provided, the main choke 66. The flow meter 70 may be provided either in the conduit 26 itself, or in a short looped conduit which extends from a first point to a second point in the main conduit 26. In the latter case, a first valve is preferably provided in the main conduit 26 between the first point and the second point, and a second valve provided in the looped conduit, such that when the first valve is open and the second valve closed, mud flow is through the main conduit 26 only and there is no flow through the flow meter, whereas when the first valve is closed and the second valve open, all the mud flowing into the drill pipe 12 flows via the flow meter 70. This flow meter 70 may thus be used to measure the rate of mud flow into the drill pipe 12.

Where both a main choke 66 and flow meter 70 are provided, the driller may therefore adjust the rate of mud being transmitted to the drill pipe 12 by opening or closing the choke 66 with remote control from the rig control floor centre, using the flow meter 70 to ascertain the flow rate.

A flow meter 80 may also be provided in the overflow conduit 42 downstream of the choke 44 to measure the rate of mud flow into the mud reservoir 22. Where both such flow meters are provided the readings from each may be combined to provide an indication of the total output of the mud pump 24.

In prior art systems, the volume pumped into the drill pipe 12 may be measured by counting the pump strokes of a pump with a stroke counter. With displacement volume being constant it is possible in this way to derive the volume pumped, and this is the usual method of displaying the flow rate at the rig floor control centre. If, however, the pump valves leak or if the pump loses suction, the derived flow rate may not be entirely accurate. By providing flow meters in the second conduit 26 and the overflow conduit 42, the flow rates measured using both of these flow meters can be combined, and the result used to verify the accuracy of the flow rate calculated from the count of pump strokes as in the prior art method.

A second embodiment of the invention is illustrated in FIG. 3, and includes a rotating control device (RCD) 32. As is conventional in the art, the RCD 32 includes sealing elements which seal against the drill pipe 12 whilst still allowing the drill pipe 12 to rotate, and a laterally extending outlet 32*a* located below the sealing elements by means of which controlled release of fluid from the annulus 13 via the annulus return conduit 36 may be achieved. Unlike the arrangement shown in FIGS. 1 and 2, the RCD 32 is configured to contain fluid pressure in the annulus 13.

This embodiment of drilling system also includes an annulus return choke 46 which is located in the annulus return conduit 36 between the outlet 32*a* of the RCD and the filter 38. This choke 46 is also controllable by means of an electronic control unit 52 to vary the extent to which mud flow along the annulus return conduit 36 is restricted. If the annulus return choke 46 is opened, rapid return of mud from the annulus 13 to the mud reservoir 22 is permitted, whereas if the annulus return choke 46 is closed, flow of mud from the annulus 12 to the mud reservoir 22 is restricted, and this results in an increase in fluid pressure in the annulus 13, which increase in pressure is contained by the RCD 32.

A flow meter 90 is provided in the annulus return conduit 26 to monitor the rate of return of fluid from the annulus 13 to the mud reservoir 22. Typically this flow meter is a Coriolis meter and is located between the annulus return choke 46 and the filter 38.

As mentioned above, it will be appreciated that the bottom hole fluid pressure is determined by two factors—namely the rate of flow of mud into the borehole 10 along the drill pipe 12, and the rate of flow of mud out of the borehole 10 via the annulus 13. The annulus return choke 46 therefore provides a means of controlling the bottom hole mud pressure. In the event that the flow of mud into the annulus is suddenly reduced during an event such as plugging of the drill pipe 12 or stalling of the motor, to prevent an unwanted sudden drop in the bottom hold pressure, which as mentioned above, could result in the release of hydrocarbons from the formation, the driller may therefore manually operate the annulus return choke 46 to restrict flow of mud along the annulus return conduit 36 in order to maintain the bottom hole pressure at the desired level.

Also by providing for automatic control of the annulus return choke 46 in the same way as for the overflow choke 44, i.e. by providing the ECU 52 with an input from a pressure sensor 47 which measures the annulus fluid pressure and programming this ECU 52 to adjust the annulus return choke 46 automatically to bring the annulus pressure to a desired value, the system can be set up to provide a constant back-pressure on the annulus 13, in addition to a constant pressure in the drill pipe 12. This can assist in maintaining the bottom hole pressure at a sufficiently high, if not constant, level to avoid unintended release of hydrocarbons from the formation during the connection of a new length of tubular to the drill pipe 12.

A further embodiment of drilling system is illustrated in FIG. 4, and this shows all the features of the system described above and illustrated in FIGS. 1,2, and 3 in combination with some additional features. In particular, this system includes a fifth conduit 54, hereinafter referred to as the annulus conduit 54, which extends from a point in the main conduit 26 between the overflow conduit 42 and the standpipe manifold 28, to the annulus 13 via the bell-nipple 33 and the BOP 34. A valve 60 and a further electronically controllable annulus choke 63 are provided in the annulus conduit 54, the valve 60 being up-stream of the annulus choke 63, i.e. between the annulus choke 63 and the main conduit 26. A further Coriolis flow meter 65 is provided in the annulus conduit 54 between the choke 63 and the BOP 34. Operation of the annulus choke 63 is controlled with an associated ECU 64 in the same manner as the overflow choke 46, and the annulus choke 63 may be closed to restrict flow of mud from the main conduit 26 to the annulus 13 or may be opened to increase the diameter of the flow path from the main conduit 26 to the annulus 13. Ordinarily, during drilling, the valve 60 is closed to prevent flow of mud along the annulus conduit 54, and the annulus conduit 54 used only during changeover as described below. The valve 60 may, however, be open during drilling, The valve 60 in the annulus conduit 54, the annulus choke 62 and the main choke 66 may be operated to allow for controlled breaking of the connection between the top drive 30 and the drill pipe 12, for example when the borehole 10 has become so deep that it is necessary to add a new section of tubing to the top of the drill pipe 12. In this case, the system is operated as follows.

With the annulus choke 63 closed, the valve 60 in the annulus conduit 54 is opened, and then the annulus choke 63 adjusted, in this example, until the Coriolis flow meter 65 in the annulus conduit 54 indicates that mud is flowing along the annulus conduit 54 at a rate of between 100 and 150 US gallons per minute. The main choke 66 is then closed on a predetermined closure curve selected to avoid any spikes in bottomhole pressure as a result of wellbore storage effects. Whilst this is occurring, the overflow choke 46 ensures that the pressure in the main conduit 26 and the annulus conduit 54 is generally constant, which means that the rate of flow of mud through the annulus choke 63 into the annulus 13 stays generally constant. Thus, in order to compensate for the loss in bottomhole pressure due to the closing of the main choke 66, the annulus return choke 46 must also be closed to restrict, but not completely prevent, flow of mud along the annulus return conduit 36 and therefore increase the back pressure on acting on the mud returning from the annulus 13. Once the main choke 66 is completely closed, so that flow of mud into the drill pipe 12 is substantially prevented, the top drive 30 may be disconnected from the drill pipe 12, and the new section of tubing inserted into the drill pipe 12. Whilst this is occurring, the pump speed may be reduced to reduce the amount of mud being pumped straight back into the mud reservoir 22 via the overflow conduit 42, whilst maintaining the desired flow rate along the annulus conduit 54.

By virtue of this simultaneous control of the main choke 66 and the annulus return choke 46, the bottom hole pressure may be kept at a generally constant level during the controlled breaking of the connection between the top drive 30 and the drill pipe 12. Such control of the bottom hole pressure is achievable because of the constant pressure supply to the main choke 66 facilitated by the overflow conduit 42 and control of the overflow choke 44. This ensures that the effect of closing the choke 66 is generally predictable, and based on this predictable response, it is possible to drive the annulus return choke 46 to maintain a constant bottom hole pressure during the connection process.

After reconnection of the top drive 30, in order to restart drilling and hence pumping of mud into the drill pipe 12, the process is reversed, with the main choke 66 and the annulus return choke 46 being opened together. It should be appreciated, however, that the main choke 66 is opened at a different rate to that at which it was closed, as the fluid dynamics of recommencing mud flow into the drill pipe 12 have a different effect on the bottomhole pressure than reduction in mud flow into the drill pipe 12 during the disconnection process.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A control apparatus for use in controlling the fluid pressure in a borehole during drilling of the borehole, the apparatus including an inlet suitable for connection to a pump, a main outlet suitable for connection to a drill pipe, and an overflow outlet suitable for connection to a fluid reservoir, the inlet being connected to the main outlet by a main flow conduit, and the overflow outlet being connected to the main flow conduit by means of an overflow conduit, wherein the overflow conduit is provided with a pressure regulator by means of which the pressure of fluid in the main flow conduit may be maintained at or around a predetermined pressure value, wherein the apparatus also includes a further choke which is located in the main flow conduit between the overflow conduit and the main outlet and which is adjustable to vary the degree of restriction of flow of fluid along the main flow conduit.

2. A control apparatus according to claim 1 wherein the pressure regulator comprises a choke which is adjustable to restrict flow of fluid along the overflow conduit to a greater or lesser extent.

3. A control apparatus according to claim 2 wherein the pressure regulator includes a pressure sensor which provides a signal indicative of the fluid pressure in either the main flow conduit or the overflow conduit between the choke and the main conduit.

4. A control apparatus according to claim 3 wherein the pressure regulator also includes an electronic control unit which is connected to the pressure sensor to receive an input signal from the pressure sensor indicative of the fluid pressure in either the main flow conduit or the overflow conduit between the choke and the main conduit, the electronic control unit being further connected to the choke and programmed to generate and transmit to the choke a control signal, receipt of which causes the choke to adjust the extent to which fluid flow along the overflow conduit is restricted.

5. A control apparatus according to claim 4 wherein the electronic control unit is programmed to monitor the signal from the pressure sensor and if the signal that the pressure differs to a specified extent from a predetermined value, to calculate and transmit to the choke one or more appropriate control signals to return the pressure to the predetermined value.

6. A control apparatus according to claim 5 wherein the electronic control unit is provided with an input adapted to receive a signal indicating the desired pressure of fluid in either the main flow conduit or the conduit between the choke and the main flow conduit, and is programmed to calculate and transmit to the choke an appropriate control signal to achieve the desired pressure.

7. A control apparatus according to claim 1 wherein a valve is provided in the overflow conduit, the valve being movable from an open position in which flow of fluid along the overflow conduit is permitted and a closed position in which the valve acts to substantially prevent flow of fluid along the overflow conduit.

8. A control apparatus according to claim 1 wherein the annulus conduit is connected to the main conduit between the overflow conduit and the choke in the main conduit.

9. A control apparatus for use in controlling the fluid pressure in a borehole during drilling of the borehole, the apparatus including an inlet suitable for connection to a pump, a main outlet suitable for connection to a drill pipe, and an overflow outlet suitable for connection to a fluid reservoir, the inlet being connected to the main outlet by a main flow conduit, and the overflow outlet being connected to the main flow conduit by means of an overflow conduit, wherein the overflow conduit is provided with a pressure regulator by means of which the pressure of fluid in the main flow conduit may be maintained at or around a predetermined pressure value, wherein the apparatus also includes an annulus outlet which is connected to the main conduit between the overflow conduit and the main outlet by an annulus conduit.

10. A control apparatus according to claim 9 wherein an adjustable choke is provided in the annulus conduit.

11. A drilling system including drill pipe, a pump, a fluid reservoir and a control apparatus for use in controlling the fluid pressure in a borehole during drilling of the borehole, wherein:

the apparatus includes an inlet suitable for connection to a pump, a main outlet suitable for connection to a drill pipe, and an overflow outlet suitable for connection to a fluid reservoir, the inlet being connected to the main outlet by a main flow conduit, and the overflow outlet being connected to the main flow conduit by means of an overflow conduit, wherein the overflow conduit is provided with a pressure regulator by means of which the pressure of fluid in the main flow conduit may be maintained at or around a predetermined pressure value;

the inlet of the control apparatus is connected to the pump, the main outlet of the control apparatus is connected to the drill pipe, and the overflow outlet of the control apparatus is connected to the fluid reservoir;

an annulus return conduit is provided between the annular region around the drill pipe and the fluid reservoir, the annulus return conduit being provided with a pressure regulator by means of which the pressure in the annular region around the drill pipe may be adjusted;

the pressure regulator comprises a choke which is adjustable to restrict flow of fluid along the annulus return conduit to a greater or lesser extent;

the pressure regulator includes a pressure sensor which provides a signal indicative of the fluid pressure in the annular region around the drill pipe; and wherein the pressure regulator also includes an electronic control unit which is connected to the pressure sensor to receive an input signal from the pressure sensor indicative of the fluid pressure in the annular region around the drill pipe, the electronic control unit being further connected to the choke and programmed to generate and transmit to the choke a control signal, receipt of which causes the choke to adjust the extent to which fluid flow along the annulus return conduit is restricted.

12. A drilling system according to claim 11 wherein a pressure containment device is provided around the drill pipe, the pressure containment device being capable of containing fluid pressure in the annular region around the drill pipe.

13. A drilling system according to claim 12 wherein the pressure containment device is a rotating control device, the rotating control device being capable of containing fluid pressure in the annular region around the drill pipe whilst allowing for rotation of the drill pipe about its longitudinal axis.

14. A drilling system according to claim 11 wherein the electronic control unit is programmed to monitor the input signal from the pressure sensor and if the pressure in the annular region around the drill pipe differs to a specified extent from a predetermined value, to calculate and transmit to the choke one or more appropriate control signals to return the pressure to the predetermined value.

15. A drilling system according to claim 14 wherein the electronic control unit is provided with an input adapted to receive a signal indicating the desired pressure of fluid in the annular region around the drill pipe, and is programmed to calculate and transmit to the choke an appropriate control signal to achieve the desired pressure.

16. A drilling system according to claim 11 wherein the drilling system further includes an annulus conduit which extends from the main conduit to the annular region around the drill pipe.

17. A drilling system according to claim 16 wherein the annulus conduit is provided with a choke which is adjustable to restrict flow of fluid along the annulus conduit to a greater or lesser extent.

18. A drilling system according to claim 16 wherein the annulus conduit is provided with a valve which is operable to substantially prevent flow of fluid along the annulus conduit.

19. A method of drilling a borehole using a drilling system including a control apparatus, the control apparatus having an inlet, a main outlet and an overflow outlet, the inlet being connected to the main outlet by a main flow conduit and the overflow outlet being connected to the main conduit by an overflow conduit, the overflow conduit being provided with a pressure regulator, the drilling system further including a drill pipe connected to the main outlet of the control apparatus, a pump connected the inlet of the control apparatus, and a fluid reservoir connected to the overflow outlet, wherein the method includes the steps of operating the pump to pump fluid into the drill pipe via the main flow conduit of the control apparatus, characterized that the method further included operating the pressure regulator to maintain the pressure of fluid in the main flow conduit at or around a predetermined level while drilling the borehole, wherein the control apparatus also includes a main choke which is located in the main conduit between the overflow conduit and the main outlet, and the method also includes the step of operating the main choke to alter the extent to which flow of fluid along the main conduit is restricted.

20. A method of drilling a borehole according to claim 19 wherein the pressure regulator comprises an adjustable overflow choke.

21. A method of drilling a borehole according to claim 20 wherein the method includes the steps of adjusting the adjustable overflow choke to increase restriction of fluid flow along the overflow conduit if the pressure of fluid in the overflow conduit is below the predetermined level or adjusting the adjustable overflow choke to decrease restriction of fluid flow along the overflow conduit if the pressure of fluid in the main flow conduit is above the predetermined level.

22. A method of drilling a borehole according to claim 19 wherein the pump is connected to the mud reservoir such that operation of the pump causes fluid in the reservoir to be pumped into the control apparatus.

23. A method of drilling a borehole according to claim 19 wherein the drilling system includes an annulus return conduit which extends between the annular region around the drill pipe and the fluid reservoir, and the annulus return conduit is provided with an annulus return choke which is adjustable to restrict flow of fluid along the annulus return conduit to a greater or lesser extent, and the method further includes the steps of operating the annulus return choke to bring the pressure in the annular region around the drill pipe to or maintain the pressure at a desired level.

24. A method of drilling a borehole according to claim 23 wherein an annulus conduit extends from the main conduit to the annular region around the drill pipe, the annulus conduit being provided with an annulus choke which is adjustable to restrict flow of fluid along the annulus conduit to a greater or lesser extent, the method further including the steps of during operation of the pump to pump fluid into the main flow conduit, adjusting the annulus choke to decrease the restriction on flow of fluid along the annulus conduit until the rate of flow of fluid along the annulus conduit reaches a predetermined amount, then adjusting the main choke to increase the restriction of flow of fluid along the main conduit, whilst at the same time adjusting the annulus return choke to increase the restriction of flow of fluid along the annulus return conduit.

25. A method of drilling a borehole according to claim 24 wherein the method further includes the step of adjusting the main choke until flow of fluid through the main choke is substantially prevented, and then disconnecting the drill pipe from the main outlet.

26. A method of drilling a borehole according to claim 23 wherein an annulus conduit extends from the main conduit to the annular region around the drill pipe, the annulus conduit being provided with an annulus choke which is adjustable to restrict flow of fluid along the annulus conduit to a greater or lesser extent, the method further including the steps of during operation of the pump to pump fluid into the main flow conduit, adjusting the main choke to decrease the restriction of flow of fluid along the main conduit, whilst at the same time adjusting the annulus return choke to decrease the restriction of flow of fluid along the annulus return conduit, and then adjusting the annulus choke to increase the restriction on flow of fluid along the annulus conduit until the rate of flow of fluid along the annulus conduit is substantially prevented.

* * * * *

UNITED STATES PATENT AND TRADEMARK OFFICE

CERTIFICATE OF CORRECTION

PATENT NO. : 9,051,803 B2
APPLICATION NO. : 13/262595
DATED : June 9, 2015
INVENTOR(S) : Christian Leuchtenberg It is certified that error appears in the above-identified patent and that said Letters Patent is hereby corrected as shown below:

IN THE CLAIMS

In Column 14, Line 42, Claim 13, the last word appears as "included" and should read --includes--.

In Column 15, Line 13, Claim 24, the word appears as "of" and should read --of,--.

In Column 16, Line 12, Claim 26, the word appears as "of" and should read --of,--.

Signed and Sealed this
Sixth Day of October, 2015

Michelle K. Lee

Michelle K. Lee
*Director of the United States Patent and Trademark Office*